US007573199B2

(12) United States Patent
Kwon et al.

(10) Patent No.: US 7,573,199 B2
(45) Date of Patent: Aug. 11, 2009

(54) PLASMA DISPLAY PANEL

(75) Inventors: Jae-Ik Kwon, Suwon-si (KR); Soo-Ho Park, Suwon-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 538 days.

(21) Appl. No.: 11/506,976

(22) Filed: Aug. 17, 2006

(65) Prior Publication Data

US 2007/0046203 A1 Mar. 1, 2007

(30) Foreign Application Priority Data

Aug. 26, 2005 (KR) ..... 10-2005-0078827

(51) Int. Cl.
*H01J 17/49* (2006.01)

(52) U.S. Cl. ..... 313/582; 313/583; 313/587

(58) Field of Classification Search ..... None
See application file for complete search history.

(56) References Cited

U.S. PATENT DOCUMENTS 7,038,382 B2 * 5/2006 Hashikawa et al. ..... 313/582
7,358,671 B2 * 4/2008 Kwon et al. ..... 313/584
2003/0020404 A1 * 1/2003 Su et al. ..... 313/582

FOREIGN PATENT DOCUMENTS

| | | |
|---|---|---|
| EP | 10 214569 | 8/1998 |
| EP | 1 528 588 | 5/2004 |
| EP | 1 505 623 A1 | 2/2005 |
| EP | 1 701 374 A1 | 9/2006 |
| JP | 10-172442 | 6/1998 |
| KR | 10-2005-0040635 | 5/2005 |

* cited by examiner

*Primary Examiner*—Ashok Patel
(74) *Attorney, Agent, or Firm*—Knobbe Martens Olson & Bear, LLP

(57) ABSTRACT

Provided is a plasma display panel (PDP) in which terminals of discharge electrodes are stably disposed. The PDP includes: first and second substrates facing each other and separated by a predetermined distance; a first group of barrier ribs interposed between the first and second substrates, and defining a plurality of discharge cells; pairs of discharge electrodes, each including: a discharge unit arranged in the first group of barrier ribs and causing a discharge; a terminal which is disposed outside the first group of barrier ribs; and a connector which connects the discharge unit and the terminal; and a support element which supports a portion of at least one connector exposed to the outside of the first group of barrier ribs.

25 Claims, 10 Drawing Sheets

PLASMA DISPLAY PANEL

BACKGROUND OF THE INVENTION

This application claims the priority of Korean Patent Application No. 10-2005-0078827, filed on Aug. 26, 2005, in the Korean Intellectual Property Office, the disclosure of which is incorporated herein in its entirety by reference.

1. Field of the Invention

The present embodiments relate to a plasma display panel (PDP).

2. Description of the Related Art

Plasma display panels (PDPs), which are increasingly being used as replacements for conventional cathode ray tubes (CRTs), are display devices that obtain images by sealing two substrates with a plurality of discharge electrodes formed thereon with a discharge gas, applying a discharge voltage to the discharge electrodes to generate ultraviolet (UV) rays, and exciting a phosphor pattern with the UV rays.

FIG. 1 is an exploded perspective view of a conventional three-electrode type surface discharge PDP 100 similar to a PDP disclosed in Japanese Patent Laid-Open No. 1998-172442. The PDP 100 includes a first substrate 101, sustain electrodes 106 and 107 disposed on a bottom surface of the first substrate 101, a first dielectric layer 109 covering the sustain electrodes 106 and 107, a protection layer 111 which covers the first dielectric layer 109, a second substrate 115 disposed to face the first substrate 101, address electrodes 117 disposed on the second substrate 115 parallel to each other, a second dielectric layer 113 covering the address electrodes 117, barrier ribs 114 disposed on the second dielectric layer 113, and a phosphor layer 110 disposed on a top surface of the second dielectric layer 113 and sidewalls of the barrier ribs 114.

However, in the conventional three-electrode type surface discharge PDP 100, 40% of visible rays emitted from the phosphor layer 110 are absorbed by the sustain electrodes 106 and 107 disposed on the bottom surface of the first substrate 101, the first dielectric layer 109 covering the sustain electrodes 106 and 107, and the protection layer 111, thereby lowering luminous efficiency. In addition, when the conventional three-electrode type surface discharge PDP 100 displays the same image for a long period of time, the phosphor layer 110 is ion sputtered by charged particles of the discharge gas, thereby causing permanent image sticking.

To address the problems mentioned above, Korean Patent Laid-Open Gazette No. 2005-40635 discloses a PDP with improved luminance and brightness efficiencies by disposing discharge electrodes on sidewalls of barrier ribs to cause a discharge.

However, in the structure in which the discharge electrodes are disposed on the sidewalls of the barrier ribs as described above, only terminals of discharge electrodes connected to an external signal transmitting element are exposed outside a group of barrier ribs. In this case, the structure of the terminals of the discharge electrodes are weak, and thus the terminals of the discharge electrodes are susceptible to damage when connecting the terminal to the external signal transmitting element.

In other words, if the terminals of the discharge electrodes alone are exposed outside the group of barrier ribs without a separate support, the terminals are shaped in a cantilever beam. Generally, the terminals of the discharge electrodes are formed using, for example, a printing method, and thus the strength of the terminals is weak in addition to being susceptible to external forces. Consequently, the terminal of the electrode in the shape of the cantilever beam can easily be damaged by an external force applied thereto. However, in the process of connecting the terminal of the discharge electrode to the signal transmitting element, shear force and bending moment are inevitably applied to the terminal of the discharge electrodes. Thus, the terminals of the discharge electrodes get easily damaged when being coupled to the signal transmitting element, thereby increasing inferior goods rate and accordingly, increasing costs.

SUMMARY OF THE INVENTION

The present embodiments provide a plasma display panel (PDP) in which terminals of discharge electrodes are stably disposed.

According to an aspect of the present embodiments, there is provided a PDP including: first and second substrates facing each other and separated by a predetermined distance; a first group of barrier ribs interposed between the first and second substrates, and defining a plurality of discharge cells; pairs of discharge electrodes, each including a discharge unit arranged in the first group of barrier ribs and causing a discharge, a terminal which is disposed outside the first group of barrier ribs, and a connector which connects the discharge unit and the terminal; a support element which supports a portion of at least one connector exposed to the outside of the first group of barrier ribs; phosphor layers disposed in the discharge cells; and a discharge gas in the discharge cells.

According to another aspect of the present embodiments, there is provided a PDP including: first and second substrates facing each other and separated by a predetermined distance; a first group of barrier ribs interposed between the first and second substrates, and defining a plurality of discharge cells; a second group of barrier ribs interposed between the first group of barrier ribs and the second substrate; a support element interposed between a portion of the first group of barrier ribs which protrudes beyond an exterior of the second group of barrier ribs, and the second substrate; pairs of discharge electrodes, each including a discharge unit arranged in the first group of barrier ribs and causing a discharge, a terminal which is disposed outside the first group of barrier ribs, and a connector which connects the discharge unit and the terminal by being inserted into the support element; phosphor layers disposed in the discharge cells; and a discharge gas in the discharge cells.

The terminals may be disposed on the second substrate.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

The present embodiments will now be described more fully with reference to the accompanying drawings, in which exemplary embodiments are shown.

In one embodiment, a plasma display panel (PDP) according to a first embodiment will be described with reference to FIGS. 2 through 5.

Figure 2:
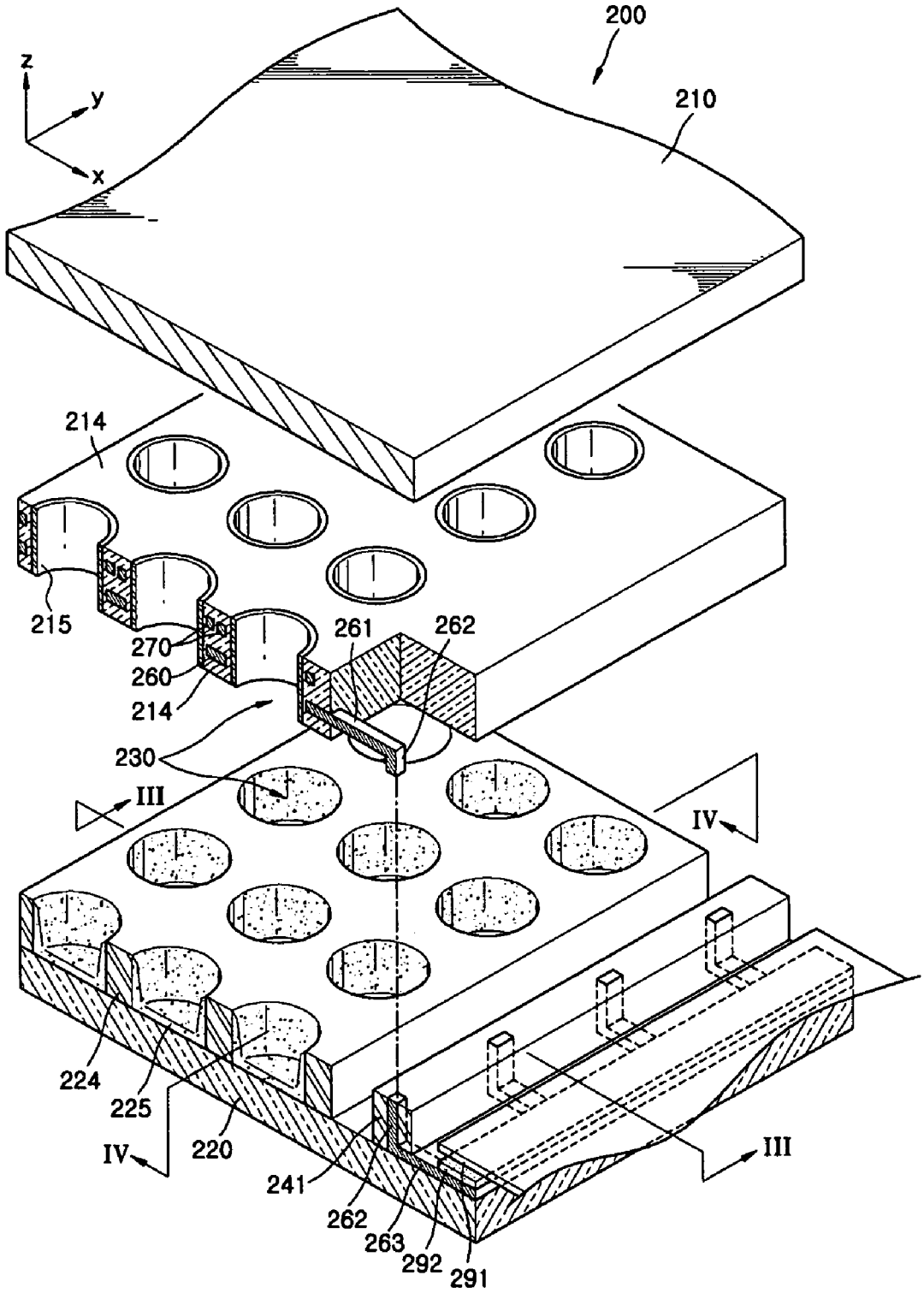
FIG. 2 is a partially cut-away exploded perspective view of a PDP according to a first embodiment.
Figure 3:
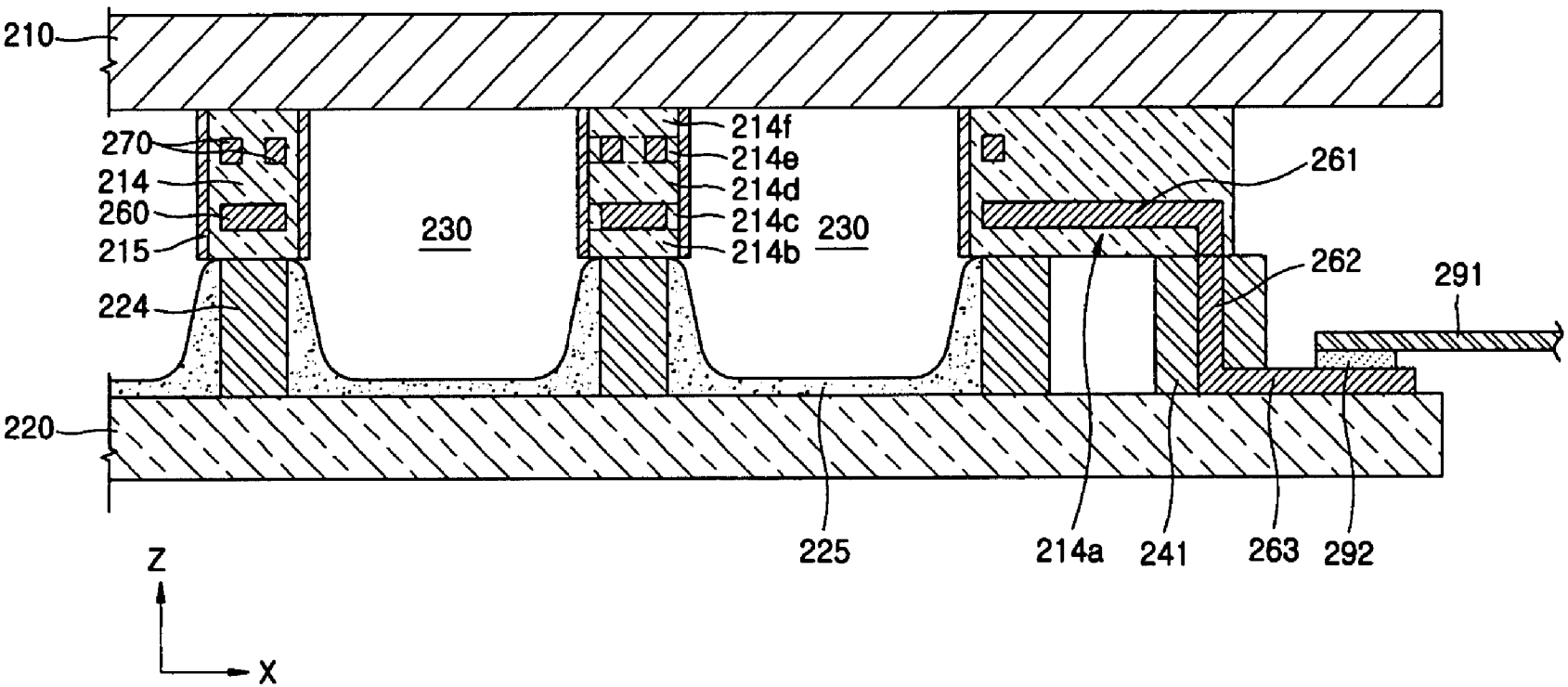
FIG. 3 is a cross-sectional view of the PDP in FIG. 2 taken along a line III-III.
Figure 4:
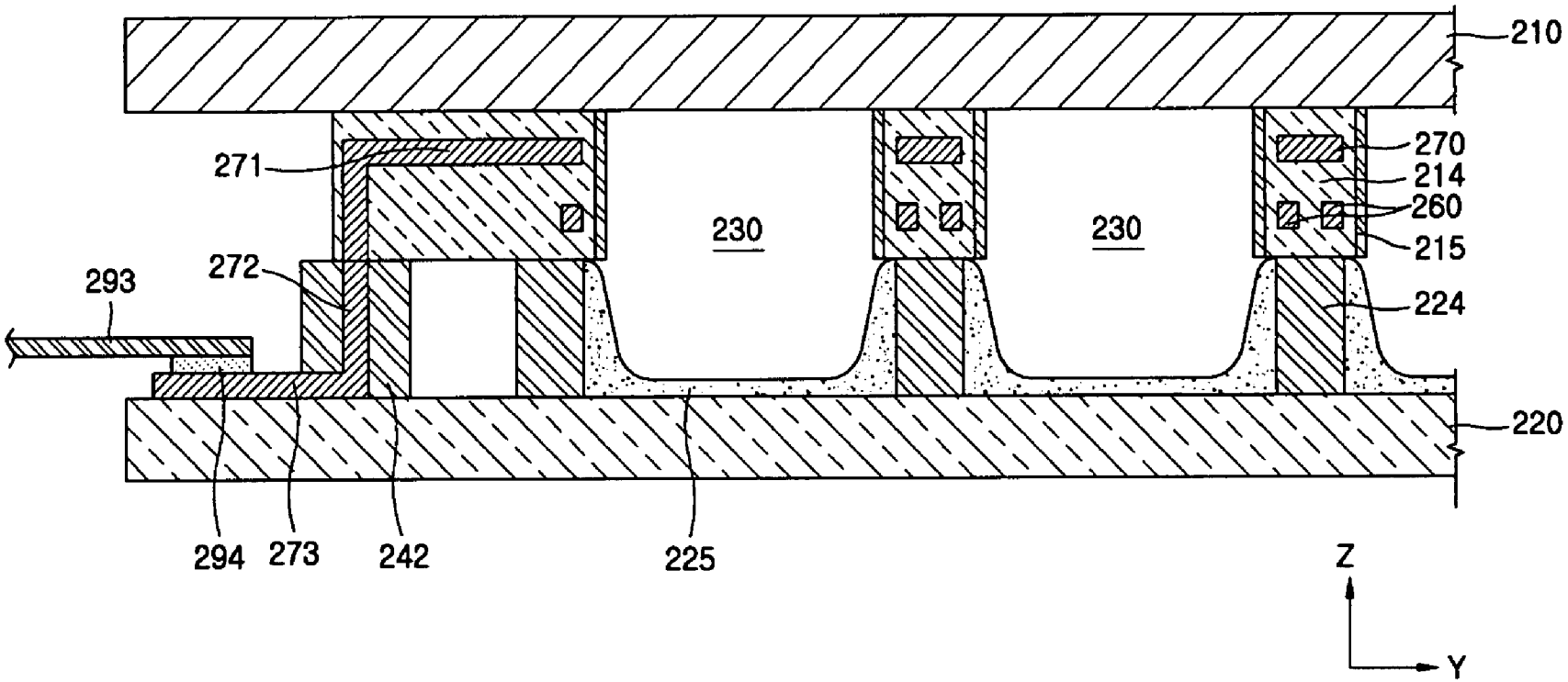
FIG. 4 is a cross-sectional view of the PDP in FIG. 2 taken along a line IV-IV.
Figure 5:
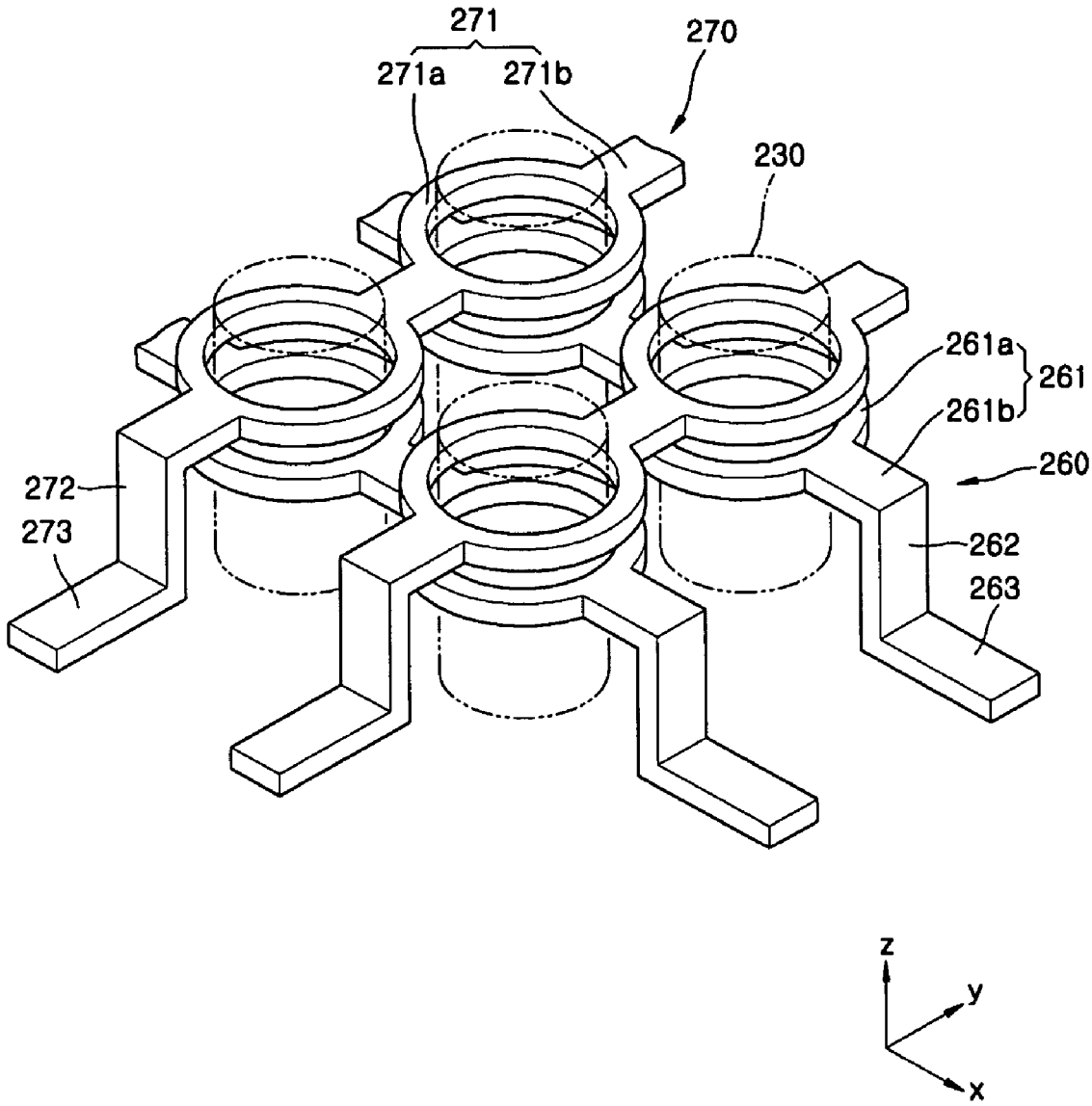
FIG. 5 is a diagram illustrating an arrangement of discharge cells and first and second discharge electrodes illustrated in FIG. 2.

FIG. 2 is a partially cut-away exploded perspective view of a PDP 200 according to a first embodiment. FIG. 3 is a cross-sectional view of the PDP 200 in FIG. 2 taken along a line III-III, and FIG. 4 is a cross-sectional view of the PDP 200 in FIG. 2 taken along a line IV-IV. FIG. 5 is a diagram illustrating an arrangement of discharge cells 230 and first and second discharge electrodes 260 and 240 illustrated in FIG. 2.

The PDP 200 includes a first substrate 210, a second substrate 220, the first discharge electrodes 260, the second discharge electrodes 270, a first group of barrier ribs 214, a second group of barrier ribs 224, protection layers 215, phosphor layers 225, first and second support elements 241 and 242, and discharge gas (not shown).

Generally, the first substrate 210 is formed of a material having excellent light transmitting properties such as glass as a main component. However, the first substrate 210 may be colored in order to reduce reflection brightness, thereby improving bright room contrast. The second substrate 220 is disposed to face the first substrate 210 at a predetermined distance. The second substrate 220 can formed of a material having excellent light transmittance properties such as glass. The second substrate 220 may be colored like the first substrate 210.

According to some embodiments, visible rays generated from the discharge cells 230 can be emitted to the outside via the first substrate 210 and/or the second substrate 220. The PDP 200 of the current embodiment does not include sustain electrodes 106 and 107, a first dielectric layer 109, and a protection layer 111 formed on a first substrate 101 of a PDP 100 illustrated in FIG. 1, and thus front transmittance of visible rays is remarkably improved. Therefore, when the PDP 200 displays an image with the same brightness as in the conventional art, the first and second discharge electrodes 260 and 270 can be driven by a relatively low voltage.

The first group of barrier ribs 214, which define the discharge cells 230, are interposed between the first and second substrate 210 and 220. In the current embodiment, dummy cells are not illustrated, encompassing the discharge cells 230 disposed at the furthest edges of the PDP 200 and not displaying images. However, the present embodiments are not limited to this, and the first group of barrier ribs 214 may define the discharge cells 230 as well as the dummy cells. In addition, the first group of barrier ribs 214 of the current embodiment define the discharge cells 230 having circular cross sections, but the present embodiments are not limited to such. That is, the first group of barrier ribs 214 may be formed in various patterns as long as they can define a plurality of discharge cells 230. For example, the cross-sections of the discharge cells 230 may be oval or polygonal such as triangular, quadrangular, and pentagonal, besides being circular.

The second group of barrier ribs 224 is interposed between the first group of barrier ribs 214 and the second substrate 220. The second group of barrier ribs 224 defines the discharge cells 230 together with the first group of barrier ribs 214. Although the second group of barrier ribs 224 define discharge cells 230 having circular cross-sections in FIG. 2, the present embodiments are not limited to such, and the second group of barrier ribs 224 may be formed in various patterns as long as the second group of barrier ribs 224 can define a plurality of discharge cells 230. In addition, the first and second groups of barrier ribs 214 and 224 may have different shapes. However, they may have the same shape to generate uniform discharge and for manufacturing convenience.

Referring to FIGS. 2 through 5, the first discharge electrodes 260 are illustrated. The first discharge electrodes 260 form pairs with the second discharge electrodes 270 and cause a discharge in the discharge cells 230. Each of the first discharge electrodes 260 includes a first discharge unit 261, a first connector 262, and a first terminal 263. The first discharge unit 261 includes first loops 261*a*, which surround each of the discharge cells 230, and first loop connectors 261*b*, which connect the first loops 261*a*. Each of the first loops 261*a* are shaped in circular rings in the current embodiment, but is not limited to such, and can be formed in various shapes such as quadrangular rings. The first loops 261*a* may be formed in substantially the same shape as the cross-sections of the discharge cells 230. Each first discharge unit 261 extends by surrounding the discharge cells 230 disposed in a single line, and the first connector 262 is disposed at one end of the first discharge unit 261. The first connector 262 extends in a substantially perpendicular direction (z direction) with respect to the second substrate 220, and is electrically connected with the first terminal 263 disposed on the second substrate 220. This will be described in more detail.

Referring to FIGS. 2 and 3, at least one portion (that is, a protruding portion 214*a*) of the first group of barrier ribs 214 protrudes beyond a portion of the second group of barrier ribs 224 by a predetermined distance in a horizontal direction. The first discharge unit 261 extends into the protruding portion 214*a*. In addition, the first terminal 263 is disposed on the second substrate 220 to be electrically connected to an external first signal transmitting element 291. The first terminal 263 is disposed along edges of the second substrate 220. The first terminal 263 is disposed to correspond to the first discharge unit 261. The first terminal 263 and the first discharge unit 261 are electrically connected via the first connector 262. However, since the first connector 262 is disposed in a substantially perpendicular direction with respect to the first discharge unit 261 and the first terminal 263 at the protruding portion 214*a* of the first group of barrier ribs 214, a portion of the first connector 262 is exposed to the outside of the first group of barrier ribs 214. The exposed portion of the first connector 262 is structurally weak, and thus if an impact from the outside is transmitted thereto, the exposed portion of the first connector 262 can be easily damaged. However, according to some embodiments, the exposed portion of the first connector 262 is supported by the first support element 241. That is, the first support element 241 has substantially the same height as the second group of barrier ribs 224 and is interposed between the second substrate 220 and the protruding portion 214*a* of the first barrier rib 214, and the first connector 262 is connected to the first terminal 263 by being inserted in and extending through the first support element 241. Therefore, because the first connector 262 is supported by the first support element 241, the first connector 262 is structurally stable. In the current embodiment, the first support element 241 is formed in a sheet having a predetermined length along the edges of the second substrate 220, and a plurality of first connectors 262 are formed in a single first support element 241. Thus, a single first support element 241 structurally stabilizes a plurality of first connectors 262.

The first support element 241 may be formed of numerous materials, and may be formed of an insulating material to prevent an electrical short between the first discharge electrodes 260. In addition, during a baking process when manufacturing the PDP 200, the PDP 200 can get damaged due to baking if heat expansion rates of the first support element 241 and the first group of barrier ribs 214 are different. Thus, the first group of barrier ribs 214 and the first support element 241 may be formed of the same material.

The first signal transmitting element 291 is electrically connected to the first terminal 263. The first signal transmitting element 291 electrically connects the PDP 200 and a driving circuit (not shown) of the PDP 200. Generally, the first signal transmitting element 291 is connected to a plurality of first terminals 263.

In the process of installing the first signal transmitting element 291 by coupling it to the first terminal 263, an external force is applied to the first terminal 263. The first terminal 263 is formed on the second substrate 220 so as not to get bent by the external force. Also, the first terminal 263 can better resist the shear force and bending moment.

The first signal transmitting element 291 may be a flexible printed cable (FPC), a tap carrier package (TCP), or a chip on film (COF). For example, the first terminal 263 may be installed in a one-on-one basis in each of the wires forming a FPC.

Each of the wires of the first signal transmitting element 291 may be connected to the first terminal 263 via a first anisotropic conductive film 292.

Schematic views of the second discharge electrodes 270 are illustrated in FIG. 4. The second group of discharge electrodes 270 extend perpendicular to the first discharge electrodes 260, and are separated from one another in a perpendicular direction (i.e., the z-direction) with respect to the first substrate 210 within the first group of barrier ribs 214. Here, the second discharge electrodes 270 are disposed to be closer to the first substrate 210 than the first discharge electrodes 260. However, the present embodiments are not limited to such a structure.

Each of the second discharge electrodes 270 includes a second discharge unit 271, a second connector 272, and a second terminal 273. The second discharge unit 271 includes second loops 271*a*, which surround each of the discharge cells 230, and second loop connectors 271*b*, which connect the second loops 271*a*. Each of the second loops 271*a* are shaped in circular rings in the present embodiment, but is not limited to such, and can be formed in various shapes such as quadrangular rings. Also, cross-sections of each of the second loops 271*a* may be substantially the same as those of the discharge cells 230. Each of the second discharge units 271 extends by surrounding the discharge cells 230 disposed in a single line, and the second connector 272 is disposed at one end of the second discharge unit 271. The second connectors 272 extend in a substantially perpendicular direction (i.e., the z-direction) with respect to the second substrate 220, and are electrically connected to the second terminals 273 disposed on the second substrate 220. Since the structure in which the second connectors 272 are stably supported by the second support element 242 is similar to the structure of the first discharge electrodes 260, a description thereof will be omitted. Also, since the material characteristics of the second support element 242 are similar to those of the first support elements 241, descriptions thereof will be omitted.

Each of the second terminals 273 is electrically connected to a second signal transmitting element 293 via a second anisotropic conductive film 294. A description thereof will also be omitted since it is similar to the first discharge electrodes 260.

As described above, the PDP 200 has a two-electrode type structure. Thus, one of the first and second discharge electrodes 260 and 270 act as scanning and sustain electrodes, and the other act as addressing and sustain electrodes.

Such first and second discharge electrodes 260 and 270 are not disposed to directly decrease visible light transmittance. As a result, they may be formed of conductive materials such as aluminum and copper. Therefore, since the voltage drop along the length direction of the first and second discharge electrodes 260 and 270 is small, stable signal transmittance can be obtained.

The first group of barrier ribs 214 may be formed of a dielectric material which can prevent electrical short between the first and second discharge electrodes 260 and 270 and prevent damage to the first and second discharge electrodes 260 and 270 by preventing positive ions or electrons from directly colliding with the first and second discharge electrodes 260 and 270, in addition to being able to accumulate wall charges by inducing the electrons.

The protection layers 215 are formed on sidewalls of the first group of barrier ribs 214. The protection layers 215 prevent damage to the first group of barrier ribs 214 and the first and second discharge electrodes 260 and 270 due to sputtering of plasma particles, and emit secondary electrons to lower the discharge voltage. The protection layers 215 may be formed by depositing MgO on the sidewalls of the first barrier rib 214 to a predetermined thickness.

The phosphor layers 225 are disposed on the sidewalls of the second barrier rib 224, and on a surface of the second substrate 220 between the second group of barrier ribs 224. However, the locations of the phosphor layers 225 are not limited to those described above and may be disposed elsewhere. For example, after forming a groove having a predetermined depth in a bottom surface of the first substrate 210, phosphor layers may be deposited in the grooves.

The phosphor layers 225 receive UV rays and emit visible rays. Phosphor layers formed in red discharge cells include phosphors such as $Y(V,P)O_4$:Eu, phosphor layers formed in green discharge cells include phosphors such as $Zn_2SiO_4$:Mn and $YBO_3$:Tb, and phosphor layers formed in blue discharge cells include phosphors such as BAM:Eu.

Discharge gas, which may be, for example, Ne, Xe, etc, or a mixture thereof, fills the discharge cells 230. According to some embodiments, discharge surfaces and areas may be increased, thereby increasing the amount of formed plasma, making low voltage driving possible. Therefore, even if a high concentration of Xe gas is used as a discharge gas, the PDP 200 can be driven by a low voltage, thereby drastically improving luminance efficiency. This addresses the problem of being unable to drive a conventional PDP with a low voltage when a high concentration of Xe gas is used as a discharge gas.

Hereinafter, a method of manufacturing the PDP 200 will be described in detail.

First, substantially flat first and second substrates 210 and 220 are prepared. Additional processes are unnecessary for the first substrate 210 but processes of forming the first terminals 263, the second terminals 273, the second group of barrier ribs 224, and the phosphor layers 225 on the second substrate 220 are required. First, the first and second terminals 263 and 273 are formed along edges of the second substrate 220 using a photo etching method, a photolithography method, etc. Thereafter, barrier rib paste is printed, and then the second group of barrier ribs 224 are formed using a sand blasting method etc. After the second group of barrier ribs 224 is formed, the phosphor layers 225 are formed on sidewalls of the second group of barrier ribs 224 and on portions of the second substrate 220 using a printing method, etc.

Simultaneously, a barrier rib sheet in which the first and second discharge electrodes 260 and 270 are formed is prepared. The overall shape of the barrier rib sheet is the same as the first group of barrier ribs 214, and the protection layers 215 are formed to cover sidewalls of the first group of barrier ribs 214. The barrier rib sheet is formed by stacking a dielectric sheet 214*b*, a dielectric sheet 214*c* in which the first discharge electrodes 260 are disposed, a dielectric sheet 214*d*, a dielectric sheet 214*e* in which the second discharge electrodes 270 are formed, and a dielectric sheet 214*f*. However, in the current embodiment, only the first and second discharge units 261 and 271 among the first and second discharge electrodes 260 and 270 are formed in the barrier rib sheet.

In addition, sheets for the first and second support elements 241 and 242 in which the first and second connectors 262 and 272 are formed are prepared. The sheets for the first and second elements 241 and 242 also extend in one direction.

After the first substrate 210, the second substrate 220, the barrier rib sheet, and the sheets for the first and second elements 241 and 242 are prepared, the second group of barrier ribs 224 formed on the second substrate 220 and the barrier rib sheet are aligned, and simultaneously the first and second discharge units 261 and 271 of the barrier rib sheet and the first and second connectors 262 and 272 of the sheets for the first and second elements 241 and 242 are respectively aligned, and then a baking process is performed on the barrier rib sheet and the sheets for the first and second elements 241 and 242. However, the barrier rib sheet and the sheets for the first and second elements 241 and 242 may be independently baked.

In the PDP 200 according to the first embodiment constructed as above, an address discharge occurs between the first and second discharge electrodes 260 and 270, and the discharge cells 230 in which a sustain discharge is to occur are selected as the result of the address discharge. Thereafter, when a sustain discharge voltage, which is an AC voltage, is applied between the first and second discharge electrodes 260 and 270 of the selected discharge cells 230, a sustain discharge occurs therebetween. UV rays are emitted when the energy level of the discharge gas excited by the sustain discharge is lowered. The UV rays excite the phosphor layers 225 deposited in the discharge cells 230. Visible rays are emitted as the energy level of the excited phosphor layers 225 is lowered, and the emitted visible rays are configured to form an image.

Figure 1:
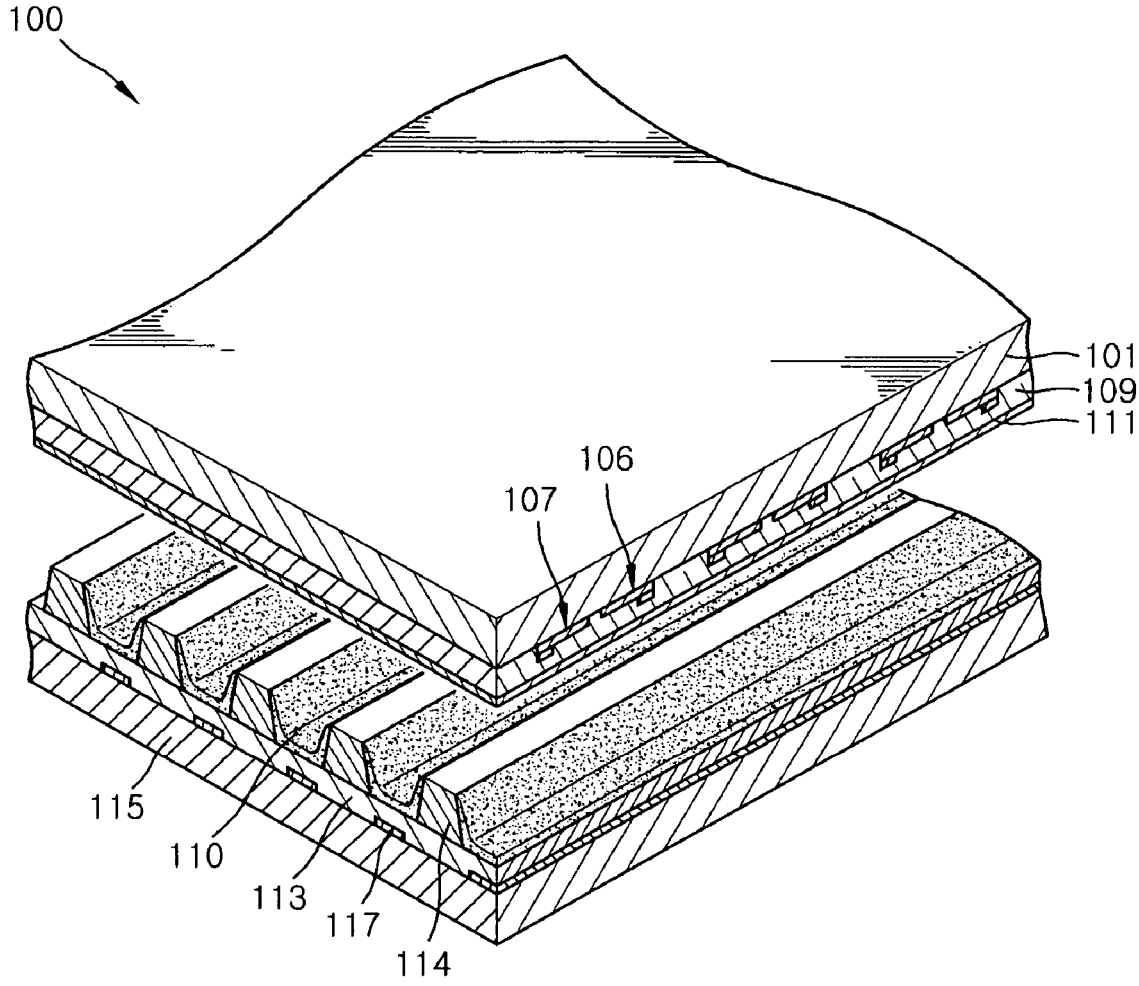
FIG. 1 is an exploded perspective view of a conventional plasma display panel (PDP)

In a conventional PDP 100 illustrated in FIG. 1, a sustain discharge between sustain electrodes 106 and 107 occurs in a horizontal direction, and thus a discharge area is relatively small. However, according to some embodiments, a sustain discharge of the PDP 200 occurs on all sidewalls defining the discharge cells 230 and discharge areas are relatively large.

In addition, the sustain discharge is generated in a closed curve shape along sidewalls of the discharge cells 230 and increasingly diffuse to the centers of the discharge cells 230. Accordingly, the volume of the regions in which the sustain discharge occurs increases, and space charges in the discharge cells 230 that are not usually used in the conventional art are used for emitting light. This results in improving luminance efficiency of the PDP 200. In particular, since the cross-sections of the discharge cells 230 are circular, uniform sustain discharge occurs on all sidewalls of the discharge cells 230.

Furthermore, since the sustain discharge occurs mainly in upper areas of the discharge cells 230, the problem in the conventional PDP 100 regarding ion sputtering by charged electrons is prevented, and thus images do not stick when displayed for a long time.

Figure 6:
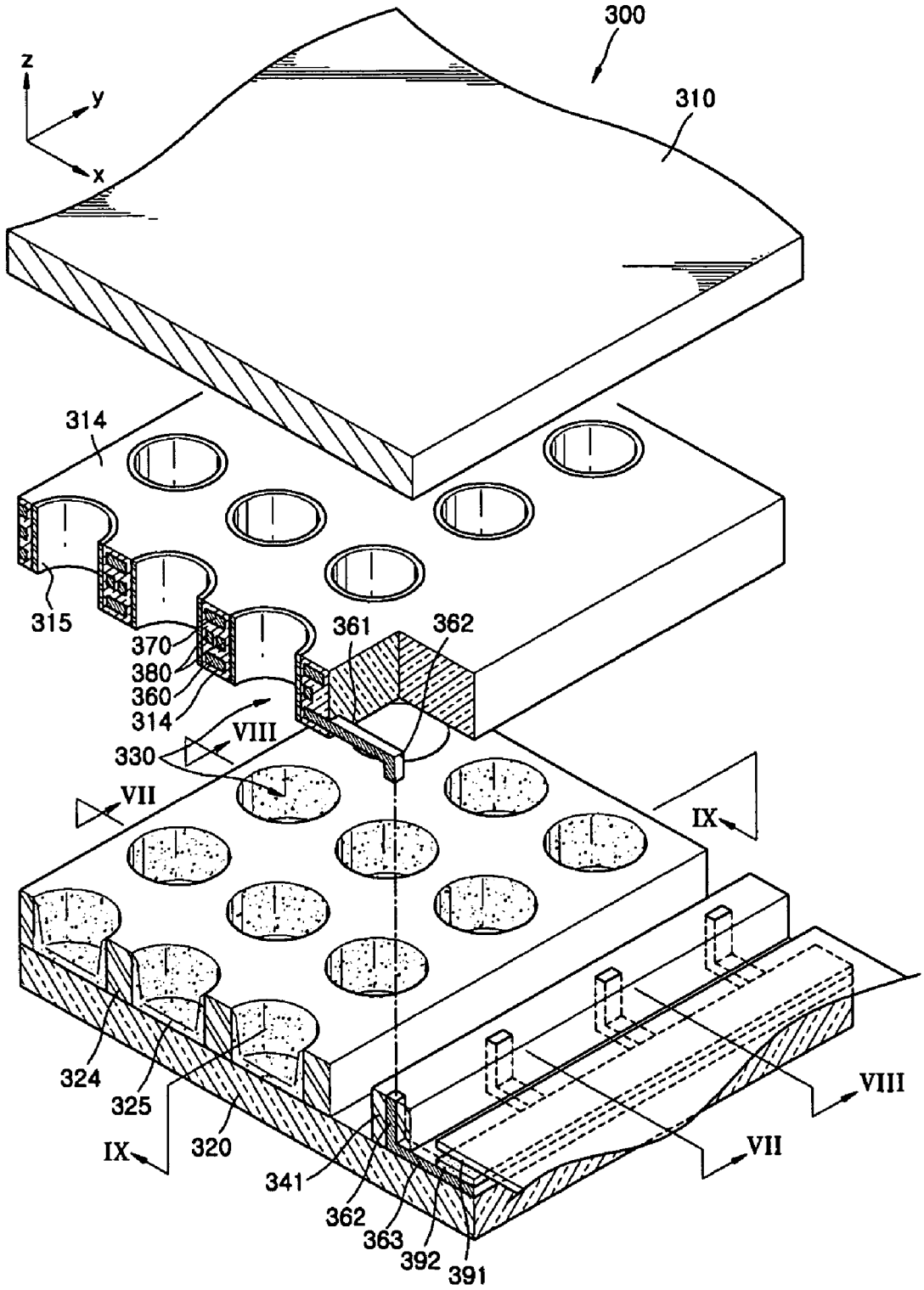
FIG. 6 is a partially cut-away exploded perspective view of a PDP according to a second embodiment.
Figure 7:
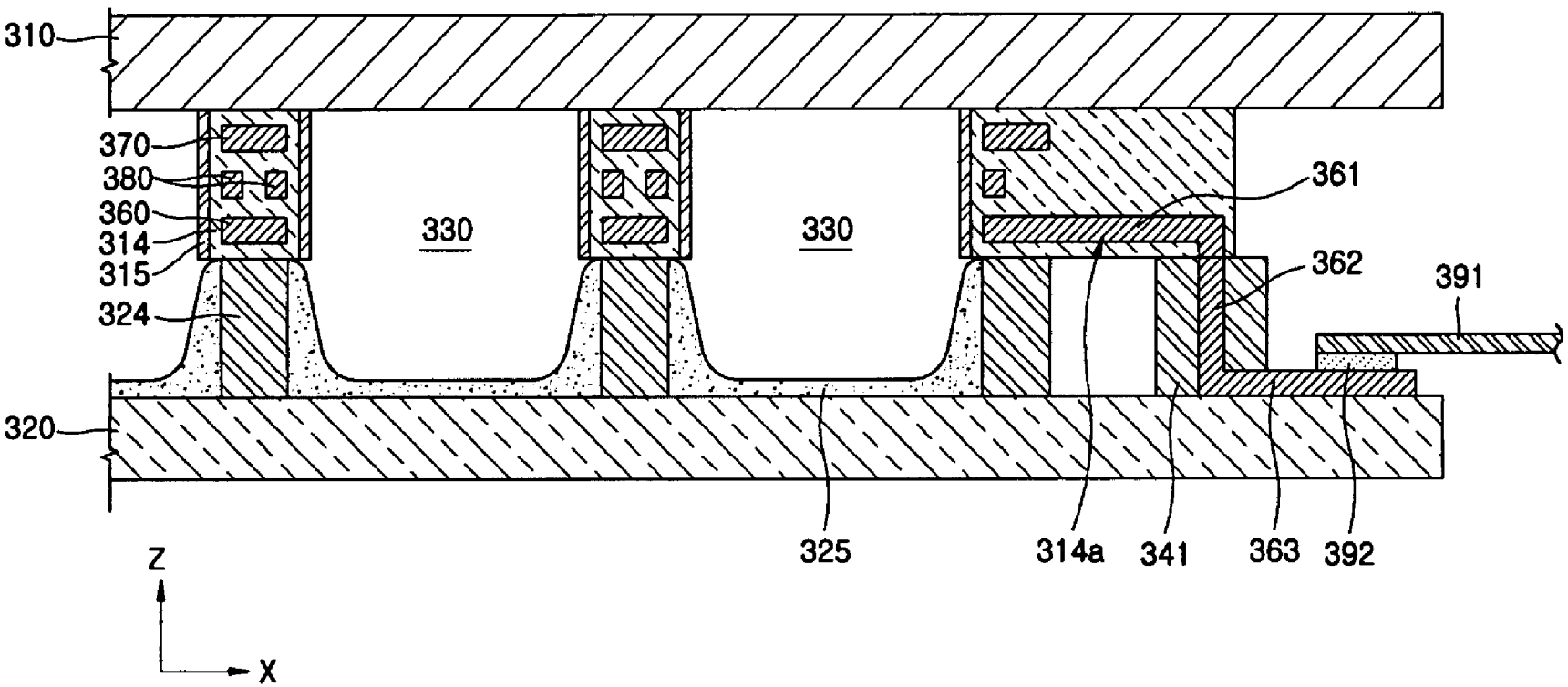
FIG. 7 is a cross-sectional view of the PDP in FIG. 6 taken along a line VII-VII.
Figure 8:
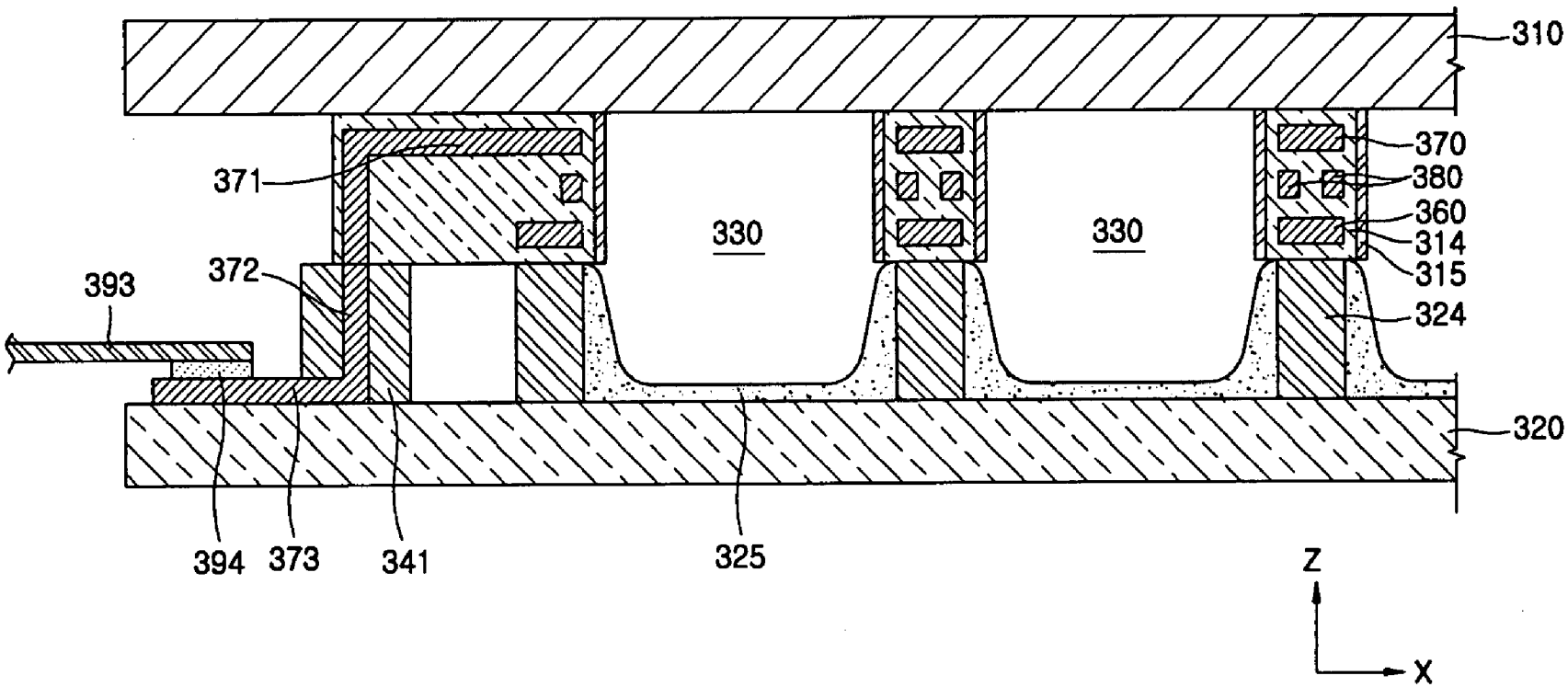
FIG. 8 is a cross-sectional view of the PDP in FIG. 6 taken along a line VIII-VIII.
Figure 9:
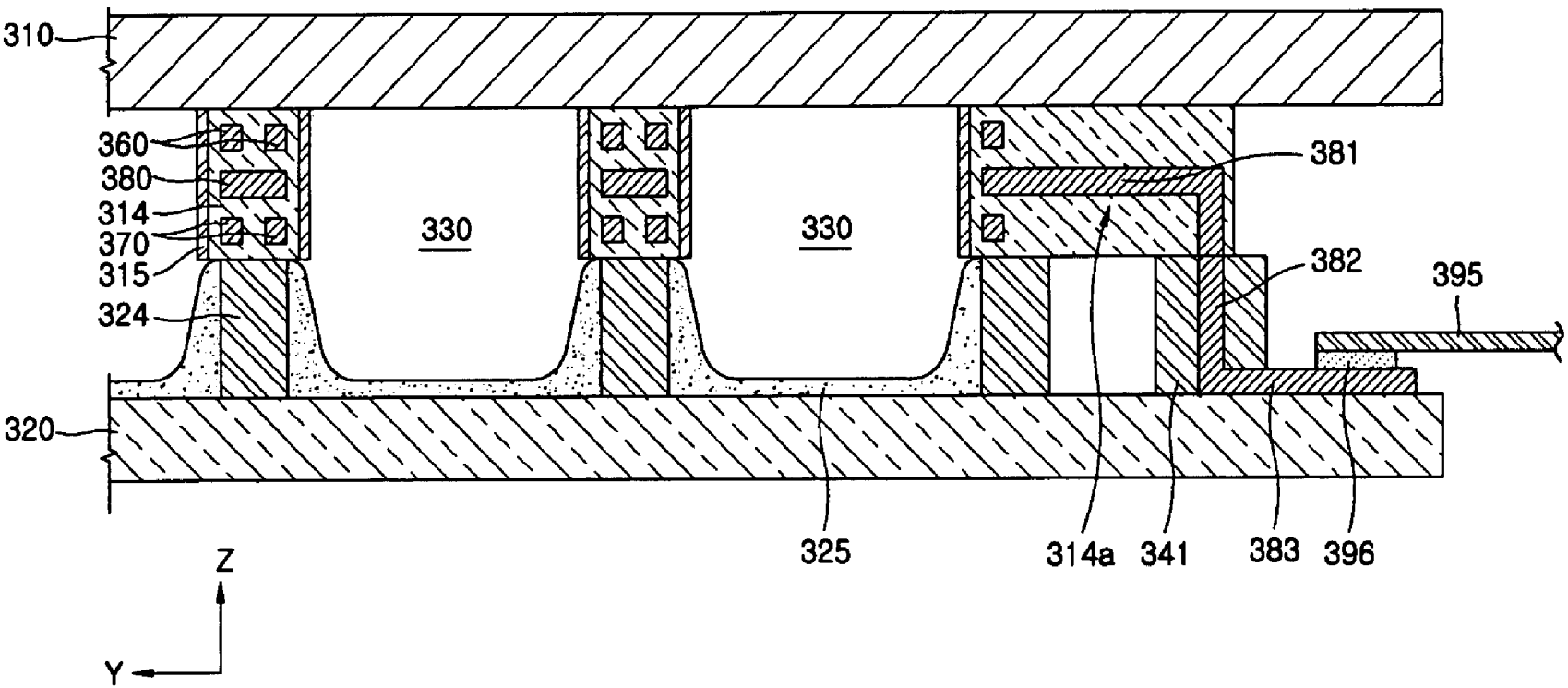
FIG. 9 is a cross-sectional view of the PDP in FIG. 6 taken along a line IX-IX.
Figure 10:
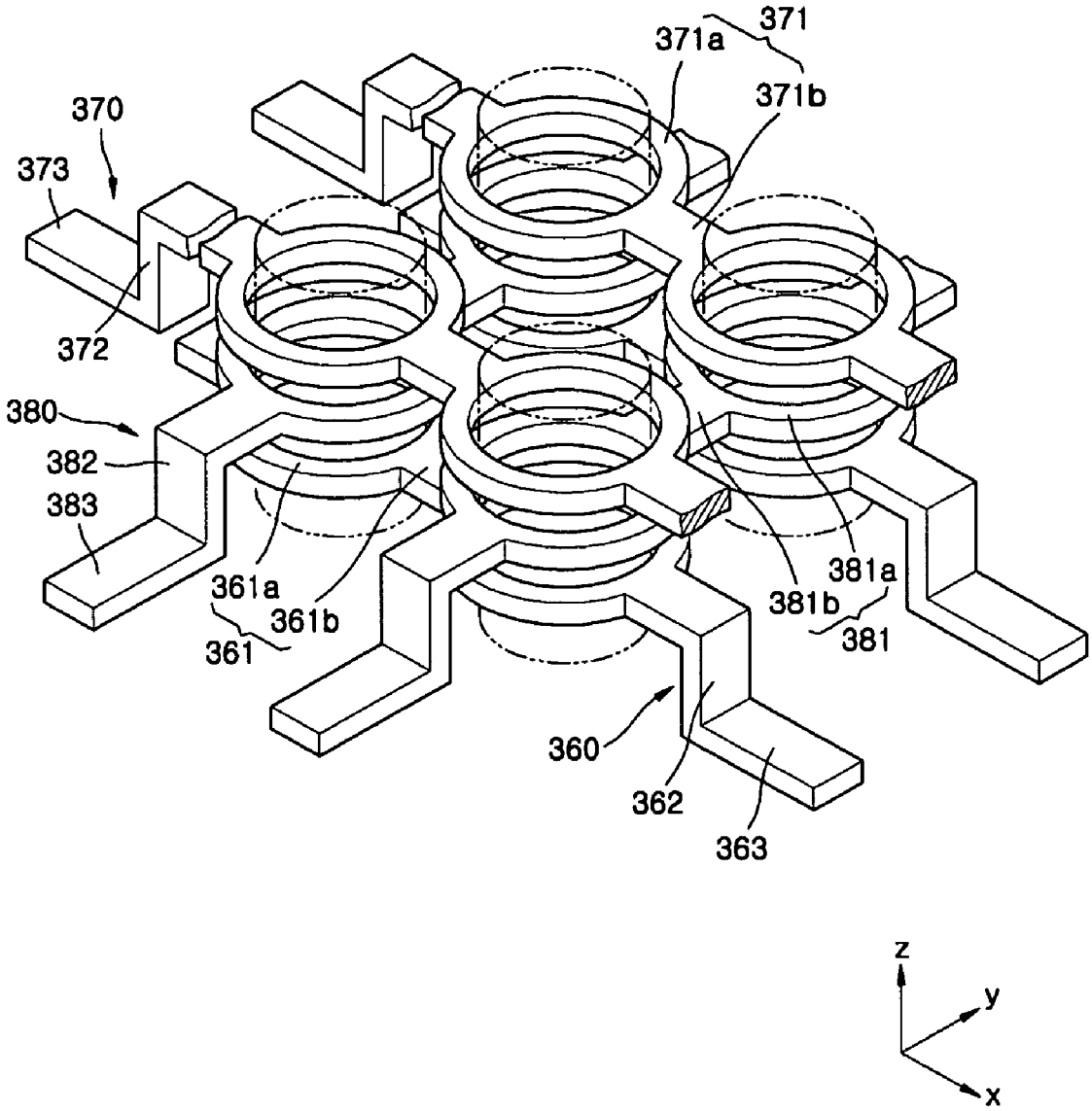
FIG. 10 is a diagram illustrating an arrangement of discharge cells, first and second discharge electrodes, and address electrodes illustrated in FIG. 6.

FIG. 6 is a partially cut-away exploded perspective view of a PDP 300 according to a second embodiment. FIG. 7 is a cross-sectional view of the PDP 300 in FIG. 6 taken along a line VII-VII, FIG. 8 is a cross-sectional view of the PDP 300 in FIG. 6 taken along a line VIII-VIII, and FIG. 9 is a cross-sectional view of the PDP 300 in FIG. 6 taken along a line IX-IX. Also, FIG. 10 is a diagram illustrating an arrangement of discharge cells 330, first and second discharge electrodes 360 and 370, and address electrodes 380 illustrated in FIG. 6.

Hereinafter, the second embodiment will be described mainly regarding features that are different from the first embodiment.

The PDP 300 includes a first substrate 310, a second substrate 320, the first discharge electrodes 360, the second discharge electrodes 370, a first group of barrier ribs 314, a second group of barrier ribs 324, protection layers 315, phosphor layers 325, first, second, and third support elements 341, 342, 343, and discharge gas (not shown).

Generally, the first substrate 310 is formed of a material having excellent light transmitting properties such as glass as a main component. However, the first substrate 310 may be colored to reduce reflection brightness, thereby improving bright room contrast. Also, the second substrate 320 separated by a predetermined distance from and facing the first substrate 310 is formed of a material having excellent light transmitting properties such as glass. Similar to the first substrate 310, the second substrate 320 may be colored.

The first group of barrier ribs 314 is interposed between the first and second substrates 310 and 320 to define a plurality of discharge cells 330. According to some embodiments, the first group of barrier ribs 314 is disposed to surround the discharge cells 330 disposed at the furthest edges of the PDP 300, and dummy cells in which images are not displayed are not illustrated. However, the present embodiments are not limited to the structure described above, and the first group of barrier ribs 314 may define the discharge cells 330 as well as the dummy cells. In addition, the first group of barrier ribs 314 of the current embodiment define the discharge cells 330 having circular cross sections, but the present embodiments are not limited thereto. That is, the first group of barrier ribs 314 may be formed in various patterns as long as they can define a plurality of discharge cells 330. For example, the cross-sections of the discharge cells 330 may be oval or polygonal such as triangular, quadrangular, and pentagonal, besides being circular.

The second group of barrier ribs 324 is interposed between the first group of barrier ribs 314 and the second substrate 320. The second group of barrier ribs 324 defines the discharge cells 330 together with the first group of barrier ribs 314. Although the second group of barrier ribs 324 defines the discharge cells 330 having circular cross-sections in FIG. 6, the present embodiments are not limited thereto, and the second group of barrier ribs 324 can be formed in various patterns as long as the second group of barrier ribs 324 can define a plurality of discharge cells 330. In addition, the first and second groups of barrier ribs 314 and 324 may have different shapes. However, they may have the same shape to generate uniform discharge and for manufacturing convenience.

Since material properties of the first and second groups of barrier ribs 314 and 324 are similar to those of the first and second groups of barrier ribs 214 and 224 of the first embodiment, descriptions thereof will be omitted.

Referring to FIGS. 6, 7, and 10, the first discharge electrodes 360 are illustrated. The first discharge electrodes 360 form pairs with the second discharge electrodes 370 and cause a discharge in the discharge cells 330. Each of the first discharge electrodes 360 includes a first discharge unit 361, a first connector 362, and a first terminal 363. The first discharge unit 361 includes first loops 361*a*, which surround each of the discharge cells 330, and first loop connectors 361*b*, which connect the first loops 361*a*. Each of the first loops 361*a* are shaped in circular rings in the current embodiment, but is not limited thereto, and can be formed in various shapes such as quadrangular rings. The first loops 361*a* may be formed in substantially the same shape as the cross-sections of the discharge cells 330.

Referring to FIG. 7, at least one portion (for example, a protruding portion 314*a*) of the first group of barrier ribs 314 protrudes beyond the exterior of a portion of the second group of barrier ribs 324 by a predetermined distance in a horizontal direction. The first discharge unit 361 extends into the protruding portion 314*a*. In addition, the first terminal 363 is disposed on the second substrate 320 to be electrically connected to an external first signal transmitting element 391. The first terminal 363 is disposed along edges of the second substrate 320. The first terminal 363 is disposed to correspond to the first discharge unit 361. The first terminal 363 and the first discharge unit 361 are electrically connected via the first connector 362. However, since the first connector 362 is disposed in a substantially perpendicular direction (the z-direction) with respect to the first discharge unit 361 and the first terminal 363 at the protruded portion 314*a* of the first group of barrier ribs 314, a portion of the first connector 362 is exposed to the outside of the first group of barrier ribs 314. The exposed portion of the first connector 362 is structurally weak, and thus if an impact from the outside is transmitted thereto, the exposed portion can easily be damaged. However, according to some embodiments, the exposed portion of the first connector 362 is supported by the first support element 341. That is, the first support element 341 has substantially the same height as the second group of barrier ribs 324 and is interposed between the second substrate 320 and the protruding portion 314*a* of the first group of barrier ribs 314, and the first connector 362 is connected to the first terminal 363 by being inserted in and extending through the first support element 341. Therefore, because the first connector 362 is supported by the first support element 363, the first connector 362 is structurally stable. In the current embodiment, the first support element 341 is formed in a sheet having a predetermined length along the edges of the second substrate 320, and a plurality of first connectors 362 are formed in a single first support element 341. Thus, a single first support element 341 structurally stabilizes a plurality of first connectors 362.

Material properties of the first support element 341 are similar to those of the first support element 241 in the first embodiment, and thus descriptions thereof will be omitted.

The first signal transmitting element 391 is electrically connected to the first terminal 363. The first signal transmitting element 391 electrically connects the PDP 300 and a driving circuit (not shown) of the PDP 300. Generally, the first signal transmitting element 391 is connected to a plurality of first terminals 363. Here, each wire of the first signal transmitting element 391 and the first terminals 363 may be connected via a first anisotropic conductive film 392.

The second discharge electrodes 370 are illustrated in FIGS. 7 and 10. The second discharge electrodes 370 extend parallel to the first discharge electrodes 360, and are separated from the first discharge electrodes 360 in a perpendicular direction (i.e., the z-direction) with respect to the first substrate 310 in the first group of barrier ribs 314. Also, each of the second discharge electrodes 370 includes a second discharge unit 371, a second connector 372, and a second terminal 373. The second discharge unit 371 includes second loops 371*a*, which encompass each of the discharge cells 330, and second loop connectors 371*b*, which connect the second loops 371*a*. Each of the second loops 371*a* are shaped in circular rings in the current embodiment, but is not limited thereto, and can be formed in various shapes such as quadrangular rings. Also, cross-sections of each of the second loops 371*a* may be substantially the same as those of the discharge cells 330. Each of the second discharge units 371 extends by surrounding the discharge cells 330 disposed in a single line, and the second connector 372 is disposed at one end of the second discharge unit 371. The second connectors 372 extend in a substantially perpendicular direction (i.e., the z-direction) with respect to the second substrate 320, and are electrically connected to the second terminals 373 disposed on the second substrate 320. The second terminals 373 are disposed on the second substrate 320 opposite to where the first terminals 363 are disposed. In more detail, the first terminals 363 are disposed at an end of the second substrate 320 in a +x direction, and the second terminals 373 are disposed at an end the second substrate 320 in a −x direction.

Since the structure in which the second connectors 372 are stably supported by the second support element 342 is similar to the structure of the first discharge electrodes 360, a description thereof will be omitted. Also, since material properties of the second support element 342 are similar to those of the first support elements 341, descriptions thereof will be omitted.

The address electrodes 380 are illustrated, for example, in FIGS. 9 and 10. The address electrodes 380 extend perpendicular to the first and second discharge electrodes 360 and 370. Also, the address electrodes 380 are separated from the first and second discharge electrodes 360 and 370 and the first substrate 310 in the vertical direction (i.e., the z-direction) in the first group of barrier ribs 314. In the current embodiment, the second discharge electrodes 370, the address electrodes 380, and the first discharge electrodes 360 are sequentially disposed in the vertical direction with respect to the first substrate 310. However, the present embodiments are not limited to such a structure, and the address electrodes 380 may be disposed the closest to or furthest from the first substrate 310, or the address electrodes 380 may be disposed on the second substrate 320.

The address electrodes 380 are for causing address discharge to facilitate sustain discharge between the first and second discharge electrodes 360 and 370. In more detail, the address discharge occurs between a scan electrode and an address electrode, and when the address discharge is terminated, positive ions accumulate at the scan electrode and electrons accumulate on a common electrode, thereby facilitating the sustain discharge between the scan electrode and the common electrode. In the current embodiment, the first discharge electrodes 360 act as the scan electrode, and the second discharge electrodes 370 act as the common electrode. However, the present embodiments are not limited to such an arrangement.

Each of the address electrodes 380 includes a third discharge unit 381, a third connector 382, and a third terminal 383. The third discharge unit 381 includes third loops 381*a*, which encompass each of the discharge cells 330, and third loop connectors 381*b*. Each of the third loops 381*a* are shaped in circular rings in the current embodiment, but is not limited to such, and can be formed in various shapes such as quadrangular rings. The third loops 381*a* may be formed in substantially the same shape as the cross-sections of the discharge cells 330. Each of the third discharge units 381 extends by surrounding the discharge cells 330 disposed in a single line, and the third connector 382 is disposed at one end of the third discharge unit 381. The third connectors 382 extend in a substantially perpendicular direction (i.e., the (−z)-direction) with respect to the second substrate 320, and are electrically connected to the third terminals 383 disposed on the second substrate 320. Since the structure in which the third connectors 382 are stably supported by the third support elements 343 is similar to the structure of the first discharge electrodes 360, a description therof will be omitted. In addition, since material properties of the third support elements 343 are similar to that of the first support elements 341, descriptions thereof will be omitted.

The third terminals 383 are electrically connected to a third signal transmitting element 395 via a third anisotropic conductive film 396. Details related to this will be omitted since they are similar to the previously described first discharge electrodes 360.

The structure, effect, and material properties of the phosphor layers 325 deposited on sidewalls of the second group of barrier ribs 324 and on a surface of the second substrate 320 are similar to those of the phosphor layers 225 described in the first embodiment. Thus, descriptions thereof will be omitted.

In the PDP 300 according to the second embodiment constructed as above, the address discharge is generated as an address voltage is applied between the address electrodes 380 and the first discharge electrodes 360, and the discharge cells 330 in which the sustain discharge is to occur are selected as the result of the address discharge.

Thereafter, when the sustain voltage, which is an AC voltage, is applied between the first and second discharge electrodes 360 and 370 of the selected discharge cells 330, a sustain discharge occurs between the first and second discharge electrodes 360 and 370. When the energy level of the discharge gas excited by the sustain discharge is lowered, UV rays are emitted. The UV rays excite the phosphor layers 325 deposited in the discharge cells 330. When the energy level of the excited phosphor layers 325 is lowered, visible rays are emitted, and the visible rays are configured to form an image.

Particular characteristics of some embodiments which occur during plasma discharge will be omitted since they are the same or similar to that of the first embodiment.

The PDP according to the present embodiments has the following effects.

First, since discharge electrodes, stably supported by a support element, are electrically connected to an external signal transmitting element, defects of the discharge electrodes are reduced.

Second, when manufacturing a PDP using a barrier rib sheet and sheets for support elements, the manufacturing process is simplified. Thus, the overall manufacturing cost of the PDP is reduced.

Third, surface discharge can occur at all sidewalls forming a discharge space. Thus, discharge surfaces can be largely expanded.

Fourth, a discharge occurs at sidewalls of the discharge cells and diffuses to the centers of the discharge cells. Thus, the entire discharge cells can be efficiently used since discharge regions are better utilized compared to the conventional art. As a result, the PDP can be driven by a low voltage, thereby improving luminance efficiency.

Fifth, since the PDP can be driven by a low voltage, low voltage driving is possible even if a high concentration Xe gas is used as a discharge gas, thereby improving luminescence efficiency.

Sixth, discharge response speed is fast, and low voltage driving is possible. The discharge electrodes are not disposed on first and second substrates through which visible light is emitted, but are disposed on sidewalls of barrier ribs. Thus, electrodes with low resistance, for example, metal electrodes, may be used as the discharge electrodes since transparent electrodes with high resistance need not be used as the discharge electrodes. As a result, the discharge response speed is fast, and low voltage driving is possible without any distortion of electric waveforms.

Seventh, image sticking may be fundamentally prevented. An electric field created by the voltage applied between the discharge electrodes formed on sidewalls of the barrier ribs concentrates the plasma to the center of the discharge space. Thus, even if the discharge occurs for a long time, ions generated by the discharge are prevented from colliding with the phosphors by the electric field. Consequently, image sticking caused by ion sputtering which damages the phosphors can be fundamentally prevented. In particular, image sticking caused a serious problem when using high concentration Xe gas as the discharge gas, but the present embodiments fundamentally prevent such image sticking.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel (PDP) comprising:

first and second substrates facing each other and separated by a predetermined distance;

a first group of barrier ribs interposed between the first and second substrates, and defining a plurality of discharge cells;

one or more discharge electrodes, each including:

a discharge unit arranged in the first group of barrier ribs configured to cause a discharge;

a terminal which is disposed outside the first group of barrier ribs; and a connector which connects the discharge unit and the terminal;

a support element which supports a portion of at least one connector exposed to the outside of the first group of barrier ribs;

phosphor layers disposed in the discharge cells; and a discharge gas in the discharge cells.

2. The PDP of claim 1, wherein the terminals are disposed on the second substrate.

3. The PDP of claim 1, further comprising a second group of barrier ribs interposed between the first group of barrier ribs and the second substrate.

4. The PDP of claim 3, wherein at least one portion of the first group of barrier ribs protrudes beyond an exterior of the second group of barrier ribs, and wherein the connector extends between the protruding portion of the first group of barrier ribs and the second substrate.

5. The PDP of claim 4, wherein the support element is disposed between the protruding portion of the first group of barrier ribs and the second substrate, and the height of the support element is substantially the same as the height of the second group of barrier ribs.

6. The PDP of claim 1, wherein the connectors are disposed along an edge of the second substrate, and the support element insulates at least two connectors.

7. The PDP of claim 1, wherein the discharge electrodes surround each of the discharge cells arranged in a single line.

8. The PDP of claim 1, wherein the discharge electrodes form pairs which are substantially perpendicular to each other.

9. The PDP of claim 1, further comprising address electrodes extending substantially perpendicular to the discharge electrodes, wherein the discharge electrodes are substantially parallel to each other.

10. The PDP of claim 9, wherein the address electrodes are disposed in the first group of barrier ribs.

11. The PDP of claim 9, wherein the address electrodes surround each of the discharge cells arranged in a single line.

12. The PDP of claim 3, wherein the phosphor layers are disposed on at least the sidewalls of the second group of barrier ribs.

13. The PDP of claim 1, further comprising protection layers disposed on at least the sidewalls of the first group of barrier ribs.

14. A PDP comprising:

first and second substrates facing each other and separated by a predetermined distance;

a first group of barrier ribs interposed between the first and second substrates, and defining a plurality of discharge cells;

a second group of barrier ribs interposed between the first group of barrier ribs and the second substrate;

a support element interposed between a portion of the first group of barrier ribs which protrudes beyond an exterior of the second group of barrier ribs, and the second substrate;

one or more discharge electrodes, each including:

a discharge unit arranged in the first group of barrier ribs and configured to cause a discharge;

a terminal which is disposed outside the first barrier rib; and one or more connectors which connect the discharge unit to the terminal by being inserted into the support element;

phosphor layers disposed in the discharge cells; and a discharge gas in the discharge cells.

15. The PDP of claim 14, wherein the terminals are disposed on the second substrate.

16. The PDP of claim 14, wherein the height of the support element is substantially the same as the height of the second group of barrier ribs.

17. The PDP of claim 14, wherein the support element comprises a sheet that has a predetermined width and extends along an edge of the second substrate.

18. The PDP of claim 14, wherein at least two connectors are inserted in the support element.

19. The PDP of claim 14, wherein the discharge electrodes surround each of the discharge cells arranged in a single line.

20. The PDP of claim 14, wherein the discharge electrodes formi pairs which are substantially perpendicular to each other.

21. The PDP of claim 14, further comprising address electrodes substantially perpendicular to the discharge electrodes, wherein the discharge electrodes are substantially parallel to each other.

22. The PDP of claim 21, wherein the address electrodes are disposed in the first group of barrier ribs.

23. The PDP of claim 21, wherein the address electrodes surround each of the discharge cells arranged in a single line.

24. The PDP of claim 14, wherein the phosphor layers are disposed on at least the sidewalls of the second group of barrier ribs.

25. The PDP of claim 14, further comprising protection layers disposed on at least the sidewalls of the first group of barrier ribs.

* * * * *